US008448698B2

(12) United States Patent
Genda et al.

(10) Patent No.: US 8,448,698 B2
(45) Date of Patent: May 28, 2013

(54) TUBE FOR HEAT EXCHANGER

(75) Inventors: Hiroyuki Genda, Takahama (JP); Ryoichi Sanada, Obu (JP); Akira Itoh, Kariya (JP); Masahiro Omae, Kariya (JP)

(73) Assignee: Denso Corporation, Kariya (JP)

( * ) Notice: Subject to any disclaimer, the term of this patent is extended or adjusted under 35 U.S.C. 154(b) by 985 days.

(21) Appl. No.: 12/319,422

(22) Filed: Jan. 7, 2009

(65) Prior Publication Data

US 2009/0183859 A1 Jul. 23, 2009

(30) Foreign Application Priority Data

Jan. 17, 2008 (JP) ..... 2008-007764

(51) Int. Cl.
*F28F 1/42* (2006.01)

(52) U.S. Cl.
USPC ..... 165/179; 165/151; 165/152; 165/177

(58) Field of Classification Search
USPC ..... 165/151, 152, 179, 177, 181
See application file for complete search history.

(56) References Cited

U.S. PATENT DOCUMENTS 6,378,603 B1 * 4/2002 Shimoya et al. ..... 165/153
6,478,080 B2 * 11/2002 Pinto ..... 165/153
6,595,273 B2 * 7/2003 Shimoya ..... 165/152
6,823,933 B2 * 11/2004 Chiba ..... 165/153
6,892,806 B2 * 5/2005 Pantow et al. ..... 165/179
6,935,418 B1 * 8/2005 Valaszkai et al. ..... 165/177
6,957,487 B1 * 10/2005 Valaszkai et al. ..... 29/890.053
7,011,150 B2 * 3/2006 Komatsubara et al. ..... 165/177
7,347,254 B2 * 3/2008 Pantow et al. ..... 165/179
2003/0029608 A1 * 2/2003 Shimoya ..... 165/152
2007/0227715 A1 * 10/2007 Shimoya et al. ..... 165/152
2007/0289728 A1 * 12/2007 Itoh et al. ..... 165/177

FOREIGN PATENT DOCUMENTS

JP 2004-003787 1/2004

* cited by examiner

*Primary Examiner* — Marc Norman
*Assistant Examiner* — Devon Russell
(74) *Attorney, Agent, or Firm* — Harness, Dickey & Pierce, PLC

(57) ABSTRACT

A tube for a heat exchanger includes a first and a second plate portions disposed opposite each other. At least the first plate portion includes a base plate portion bonded to the second plate portion by brazing and multiple protruding portions, which protrude from the base plate portion toward an opposite side from the second plate portion, having a first and a second protruding portions. A protruding dimension of the first protruding portion is larger than that of the second protruding portion. The base plate portion and the protruding portions extend straightly in a tube longitudinal direction. The second plate portion and the protruding portions have a clearance therebetween defining an internal fluid passage. The second protruding portion and the base plate portion are configured to define an external fluid passage extending in a tube width direction.

8 Claims, 4 Drawing Sheets

TUBE FOR HEAT EXCHANGER

CROSS REFERENCE TO RELATED APPLICATION

The present application is based on Japanese Patent Application No. 2008-007764 filed on Jan. 17, 2008, the disclosure of which is incorporated herein by reference in its entirety.

FIELD OF THE INVENTION

The present invention relates to a tube for a heat exchanger and a heat exchanger having the tube. The tube includes first and second plates which are configured to define an internal fluid passage and an external fluid passage of the tube.

BACKGROUND OF THE INVENTION

FIG. 6 shows a tube for a refrigerant condenser described in U.S. Pat. No. 6,595,273 corresponding to JP-A-2004-3787. Two plate portions are disposed opposite each other so that a flat tube 50 is configured. Each of the plate portions includes base plate portions 51 and multiple protruding portions 52, which protrude outward from the base plate portions 51.

The protruding portions 52 are disposed to be overlapped each other. Thereby, clearances are formed between the adjacent protruding portions 52. The clearances function as refrigerant passages (internal fluid passages) in which a refrigerant (an internal fluid) flows as shown by a dashed arrow "y".

The protruding portions 52 include first protruding portions 52*a* and second protruding portions 52*b*. The protruding dimension of the second protruding portions 52*b* from the base plate portions 51 is smaller than the protruding dimension of the first protruding portions 52*a* from the base plate portions 51. The first protruding portions 52*a* are formed to extend meanderingly in a tube width direction, that is, in an up-down direction in the example of FIG. 6. The second protruding portions 52*b* and the base plate portions 51 are disposed alternately between the adjacent first protruding portions 52*a*.

Therefore, air passages (external fluid passages), in which air flows in the tube width direction as shown by an arrow "z", are formed by the second protruding portions 52*b* and the base plate portions 51.

Because the air at the periphery of the external surface of the tube 50 flows in the air passages meanderingly as shown by the arrow "z", an air current is disturbed and generation of a thermal boundary layer at the periphery of the external surface of the tube 50 is suppressed. Thereby, thermal conductivity of the air is increased in the refrigerant condenser.

Hatching regions in FIG. 6 show brazing portions at which one plate portion is brazed with the other plate portion. That is, one plate portion is brazed with the other plate portion at the base plate portions 51 and end portions 53. Therefore, the base plate portions 51 can function as inner pillars for increasing pressure-resistance strength of the tube 50.

In the above-described tube, a brazing material will be filled in brazing between the opposite base plate portions 51 about at contact points of the base plate portions 51 of one plate portion and the base plate portions 51 of the other plate portion. Thereby, the brazing can be effectively performed.

When the base plate portions 51 of one plate portion and the corresponding base plate portions 51 of the other plate portion are not in contact with each other before the brazing due to the manufacturing error or the like, the brazing material is not filled between the opposite base plate portions 51 because of a lack of the contact points. Thereby, defective brazing may occur.

In the above-described tube, many separate base plate portions 51 are formed in dot shapes. Therefore, high manufacturing accuracy is required to connect all the opposite base plate portions 51 each other. It is difficult for the contact points to be provided at all the corresponding base plate portions 51. Thereby, brazing property between the two plate portions becomes worse.

The defective brazing also occurs in a tube, in which only one plate portion includes the first and second protruding portions 52*a* and 52*b* and the other plate portion has a flat shape.

SUMMARY OF THE INVENTION

It is an object of the present invention to provide a tube with two plate portions, for a heat exchanger, which can improve brazing property between the two plate portions. It is another object of the present invention to provide a heat exchanger having the tube.

According to an aspect of the present disclosure, a tube for a heat exchanger, the tube extending in a longitudinal direction and having a flat shape in cross section along a width direction substantially perpendicular to the longitudinal direction, the tube includes a first plate portion and a second plate portion located opposite to the first plate portion. At least the first plate portion of the first and second plate portions includes a base plate portion bonded to the second plate portion by brazing, and a plurality of protruding portions having at least a first protruding portion and a second protruding portion. The plurality of protruding portions protrude from the base plate portion toward an opposite side from the second plate portion. A protruding dimension of the first protruding portion from the base plate portion is larger than a protruding dimension of the second protruding portion from the base plate portion. The base plate portion and the plurality of protruding portions are configured to respectively extend in the longitudinal direction. The second plate portion and the plurality of protruding portions of the first plate portion are configured to have a clearance therebetween defining an internal fluid passage in which an internal fluid flows in the longitudinal direction. The second protruding portion and the base plate portion are configured to have a clearance therebetween defining an external fluid passage in which an external fluid flows in the width direction.

In the above configuration, a brazing property between the two plate portions in the tube for the heat exchanger can be increased.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF THE PREFERRED EMBODIMENTS

First Embodiment

Figure 1:
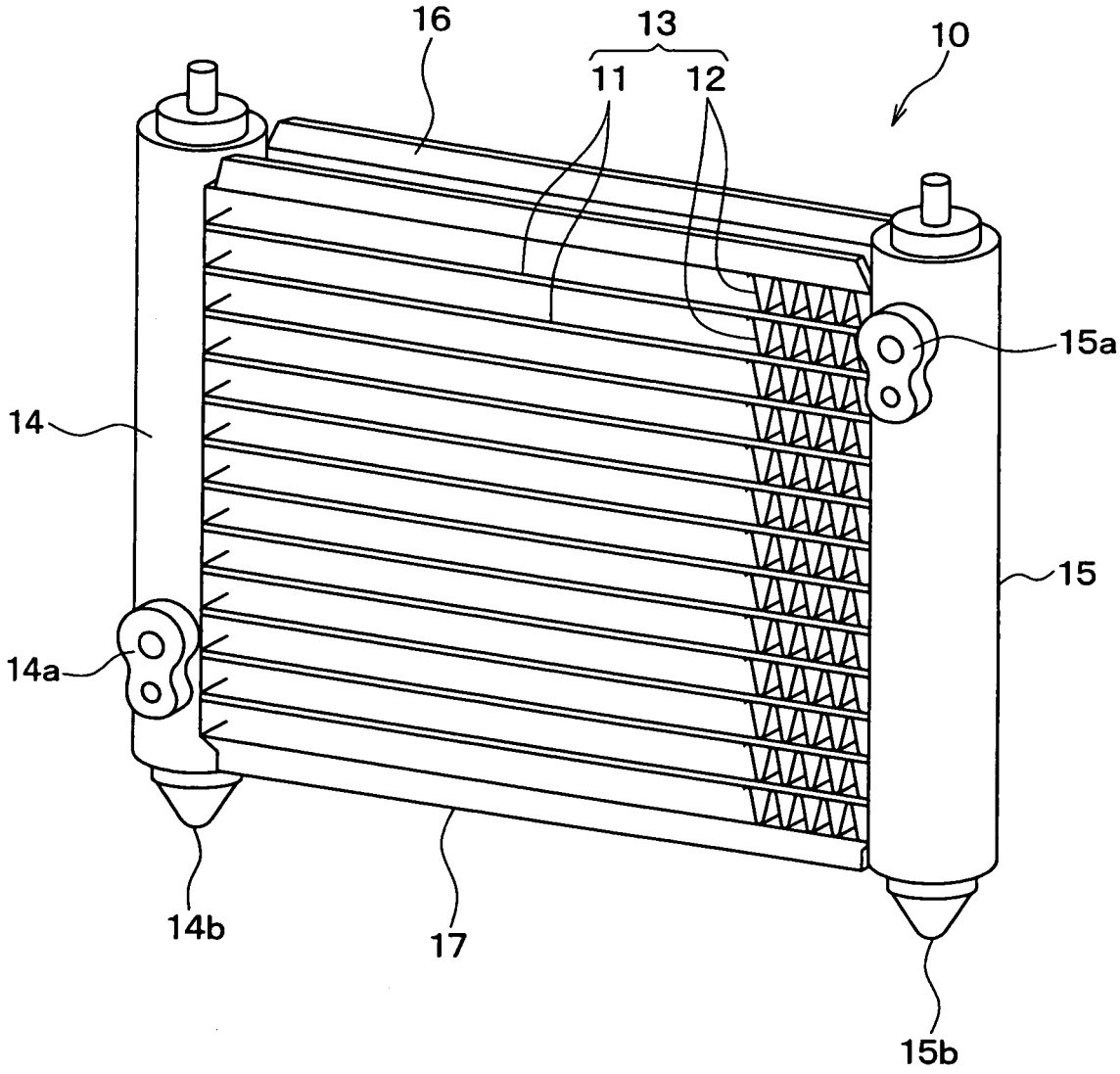
FIG. 1 is a perspective view showing a heat exchanger having a tube according to a first embodiment of the present invention.
Figure 2A:
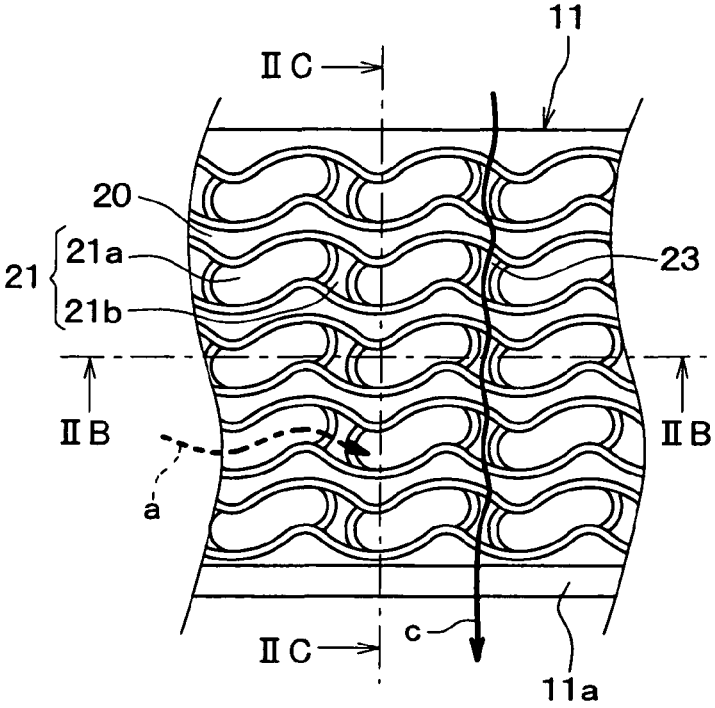
FIG. 2A is a plan view showing the tube in FIG. 1.
Figure 2C:
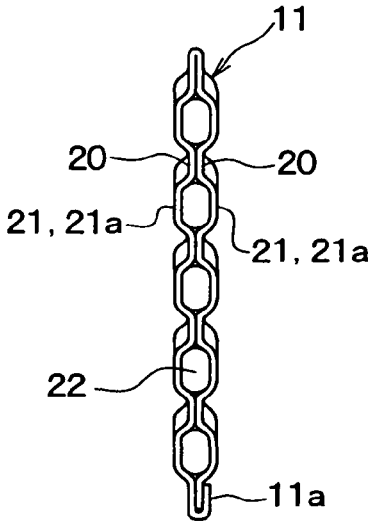
FIG. 2C is a cross sectional view showing the tube taken along line IIC-IIC in FIG. 2A.

Firstly, a first embodiment of the present invention will be described with reference to FIG. 1 to FIG. 3. In the first embodiment, a tube of the present invention is typically used for a refrigerant condenser as a heat exchanger 10.

The heat exchanger 10 cools and condenses a refrigerant by performing a heat exchange between the refrigerant (an internal fluid) having high temperature and high pressure, which is discharged from a compressor (not shown) of a refrigerant cycle, and air (an external fluid). The heat exchanger 10 includes a heat exchange portion 13 having multiple flat tubes 11 and multiple corrugated fins 12. The flat tubes 11 configure a refrigerant passage in which the refrigerant flows. Tank portions 14 and 15 are disposed at both end portions of the heat exchange portion 13 in a tube longitudinal direction.

The tank portions 14 and 15 are configured to perform branching and joining the refrigerant with respect to the tubes 11. Side plates 16 and 17 are disposed at both ends of the tank portions 14 and 15 in a tank longitudinal direction. The side plates 16 and 17 holds a rectangular outer shape of the heat exchanger 10 by connecting the tank portion 14 with the tank portion 15. The side plates 16 and 17 are parallel to the tubes 11. The tubes 11, the fins 12 and the tank portions 14 and 15 are integrally bonded by brazing.

The tank portions 14 and 15 are cylindrical containers made of an aluminum-based material including a brazing material (a welding material) clad. The tank portions 14 and 15 have multiple openings (not shown) arranged along the tank longitudinal direction. Both end portions of the tubes 11 are inserted into the openings of the tank portions 14 and 15 to be connected to the tank portions 14 and 15.

A connection block 14*a* is bonded to the tank portion 14 by brazing at one end side (e.g., a lower end side in FIG. 1) of the tank portion 14 in the longitudinal direction. The connection block 14*a* is connected to an inlet piping (not shown) for introducing the refrigerant at high temperature and high pressure, which is discharged from the compressor of the refrigerant cycle, into the tank portion 14. An engagement protrusion 14*b* for mounting the heat exchanger 10 on a vehicle body is disposed at one end (a lower end in FIG. 1) of the tank portion 14 in the tank longitudinal direction.

A connection block 15*a* is bonded to the tank portion 15 by brazing at one end side (e.g., an upper end side in FIG. 1) of the tank portion 15 in the longitudinal direction. The connection block 15*a* is connected to an outlet piping (not shown) for draining the refrigerant in the liquid phase to an expansion valve (not shown) of the refrigerant cycle from the tank portion 15. An engagement protrusion 15*b* for mounting the heat exchanger 10 on the vehicle body is disposed at another end (e.g., a lower end in FIG. 1) of the tank portion 15 in the tank longitudinal direction.

Next, the tube 11 used for the heat exchanger 10 will be described in detail. A single plate material is bent and folded in half at a center portion, and the folded half plate materials are overlapped and bonded each other so that the tube 11 is formed. In the present embodiment, the single plate material is folded such that one end portion of the plate material overlaps with another end portion of the plate material and a caulking portion 11*a* is formed at one end portion (e.g., a lower end portion in FIG. 2A) of the tube 11 in a tube width direction. Moreover, a clad material, in which the brazing material is clad on both surfaces of an aluminum plate material, is used as the plate material for forming the tube 11.

At least one of the two plate portions opposite each other in the tube 11 include flat base plate portions 20 and protruding portions 21 (i.e., punching out portions) protruding outward from the base plate portions 20. The base plate portions 20 and the protruding portions 21 are formed to be streaky and extended in the tube longitudinal direction (in a lateral direction in FIG. 2A) while extending meanderingly in a tube width direction (in an up-down direction in FIG. 2A). The base plate portions 20 and the protruding portions 21 are arranged alternately in the tube width direction as shown in FIG. 2A. Each of the base plate portions 20 is configured to extend continuously in the tube longitudinal direction, and the protruding portions 21 are sandwiched between the adjacent base plate portions 20 in the tube width direction.

The protruding portions 21 of one plate portion overlap with the protruding portions 21 of the other plate portion. Clearances formed between adjacent protruding portions 21 configure refrigerant passages 22. The refrigerant passages 22 correspond to internal fluid passages of the present invention.

The refrigerant flows in the refrigerant passages 22 in the tube longitudinal direction as shown by a dashed arrow "a" in FIG. 2A while meandering in the tube width direction.

The protruding portions 21 include first protruding portions 21*a* and second protruding portions 21*b*. The protruding dimension of the second protruding portions 21*b* from the base plate portions 20 is smaller than the protruding dimension of the first protruding portions 21*a* from the base plate portions 20. Multiple first protruding portions 21*a* and multiple second protruding portions 21*b* are arranged alternately in the tube longitudinal direction.

The first and second protruding portions 21*a* and 21*b* of one plate portion and the first and second protruding portions 21*a* and 21*b* of the other plate portion are misaligned in the tube longitudinal direction. That is, the first protruding portions 21*a* of one plate portion are opposite to the second protruding portions 21*b* of the other plate portion, and the second protruding portions 21*b* of the one plate portion are opposite to the first protruding portions 21*a* of the other plate portion.

Figure 2B:
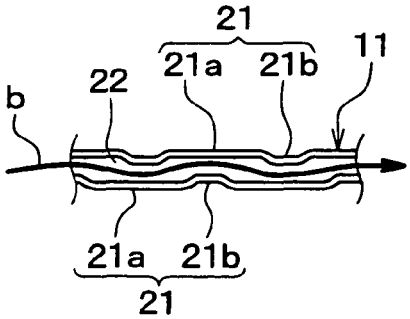
FIG. 2B is a cross sectional view showing the tube taken along line IIB-IIB in FIG. 2A.

Therefore, the refrigerant flows in the refrigerant passages 22 as shown by an arrow "b" in FIG. 2B while meandering in a tube thickness direction (in an up-down direction in FIG. 2B).

As shown by an arrow "c" in FIG. 2A, the second protruding portions 21*b* and the base plate portions 20 are configured to define air passages 23 in which air flows in the tube width direction. The air passages 23 correspond to external fluid passages of the present invention.

The base plate portions 20 and the second protruding portions 21*b* protruding slightly from the base plate portions 20 are arranged alternately in the tube width direction so that the air passages 23 are configured. Therefore, the air flows in the air passages 23 in the tube width direction with meandering in the tube thickness direction (in a direction perpendicular to the paper of FIG. 2A).

Figure 3:
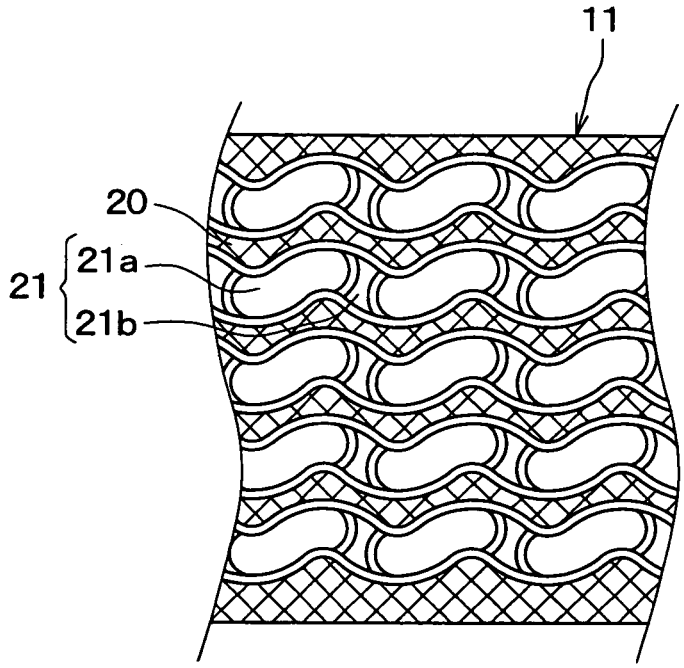
FIG. 3 is a plan view showing brazing portions of the tube in FIG. 1.

Hatching regions in FIG. 3 show brazing portions at which one plate portion is brazed with the other plate portion. One plate portion is brazed with the other plate portion at the base plate portions 20. Therefore, the brazing portions are arranged linearly to be extended in the tube longitudinal direction.

The fins 12 are configured by corrugated fins, for example. A thin plate made of an aluminum-based material (a bare material), which does not include a brazing material clad, is bent to have a wave-like shape and formed so that the corrugate fins are formed. Multiple louvers (not shown) are formed in the fin 12 at flat surfaces extended in a tube stacking direction (in the up-down direction in FIG. 1).

Next, operation with the above-described heat exchanger will be described. The refrigerant at high temperature and high pressure, which is discharged from the compressor (not shown) of the refrigerant cycle, flows into the heat exchanger 10 from the connection block 14*a*. Then, the refrigerant in the tank portion 14 is distributed into the tubes 11, and flows through the tubes 11.

The refrigerant flowing in the tubes 11 transfers heat to the tubes 11, and a part of the heat transferred to the tubes 11 from the refrigerant is transferred to the fins 12, which are connected to the tubes 11. The heat is further transferred to air flowing outside the tubes 11, and the refrigerant is cooled and condensed to become liquid. The condensed refrigerant flows from the tubes 11 into the tank portion 15 to be joined. Then, the refrigerant is discharged to the outside of the heat exchanger 10 from the connection block 15*a* and flows into the expansion valve (not shown) of the refrigerant cycle.

Next, heat exchanging operation between the refrigerant and air in the heat exchange portion 13 of the heat exchanger 10 will be explained. As shown by the dashed arrow "a" in FIG. 2A and the arrow "b" in FIG. 2B, the refrigerant flows in the tube 11 meanderingly and a refrigerant current is disturbed. Thereby, thermal conductivity of the refrigerant is increased in the heat exchange portion 13.

Air flowing in a space apart from the outer surface of the tubes 11 of air flowing outside the tubes 11 flows along the fins 12 and absorbs heat from the fins 12 to cool the fins 12. Thereafter, the air flows downstream in an air flow of the fins 12.

Air flowing in the peripheral portion of the tubes 11 of air flowing outside the tubes 11 absorbs heat from the tubes 11 to cool the tubes 11. Thereafter, the air flows downstream in an air flow of the tubes 11. At this time, the air flows in the air passages 23 meanderingly and an air current is disturbed. Thereby, thermal conductivity of the air is increased in the heat exchange portion 13. In addition, a heat transfer area of the tubes 11 can be expanded by the bent air passages, and the amount of heat radiation from the tubes 11 is increased.

In the present embodiment, the base plate portions 20 are formed to be streaky and extended continuously in the tube longitudinal direction. Thus, it becomes easier for the corresponding base plate portions 20 to bond each other compared to the structure that the base plate portions 51 are formed in dot shapes. The contact points for starting filling of the brazing material can be easily provided. Therefore, the brazing property between opposite base plate portions 20 can be increased.

Second Embodiment

Figure 4:
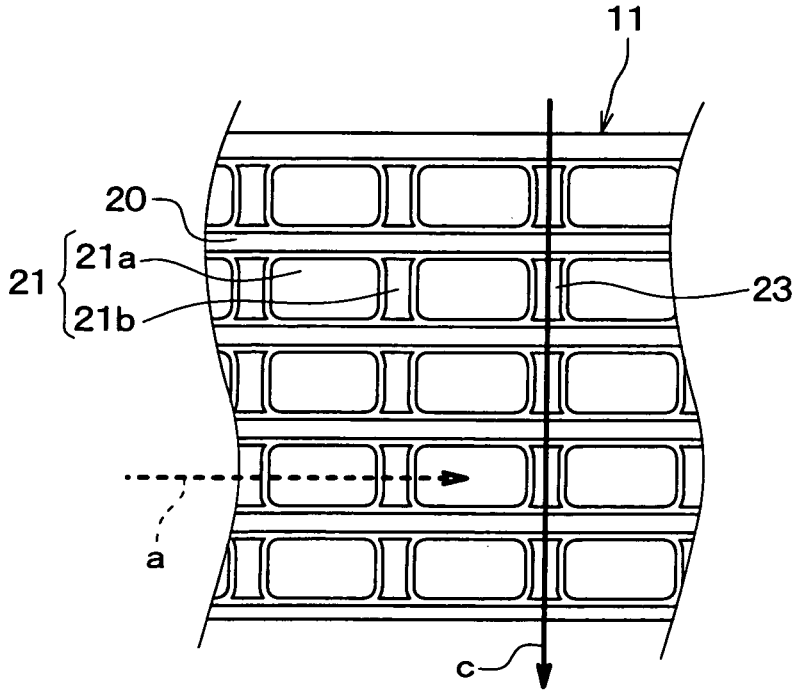
FIG. 4 is a plan view showing a tube for a heat exchanger according to a second embodiment of the present invention.

In contrast to the first embodiment, in the second embodiment, the protruding portions 21 are formed to be streaky and extended straightly in the tube longitudinal direction as shown in FIG. 4. A planar shape of the first protruding portions 21*a* is a substantially rectangular shape. Each of the base plate portions 20 is configured to extend approximately straightly and continuously in the tube longitudinal direction, and the protruding portions 21 are sandwiched between the adjacent base plate portions 20 in the tube width direction. Furthermore, the second protruding portions 21*b* and the base plate portions 20 are configured such that the air passage 23 extends in the tube width direction approximately straightly.

The same effect can be obtained even in the second embodiment as well as the first embodiment. In the example of FIG. 4, the caulking portion 11*a* is not shown.

Third Embodiment

Figure 5:
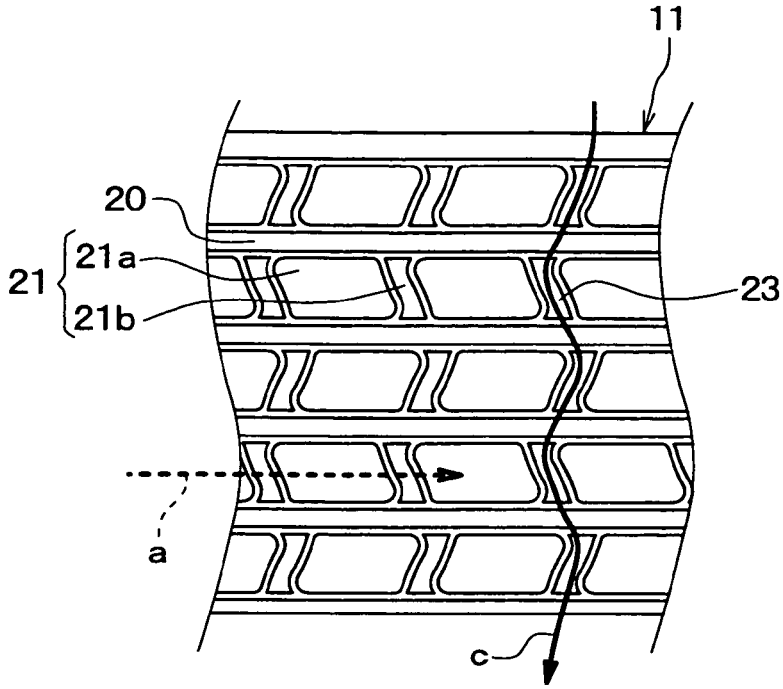
FIG. 5 is a plan view showing a tube for a heat exchanger according to a third embodiment of the present invention.
Figure 6:
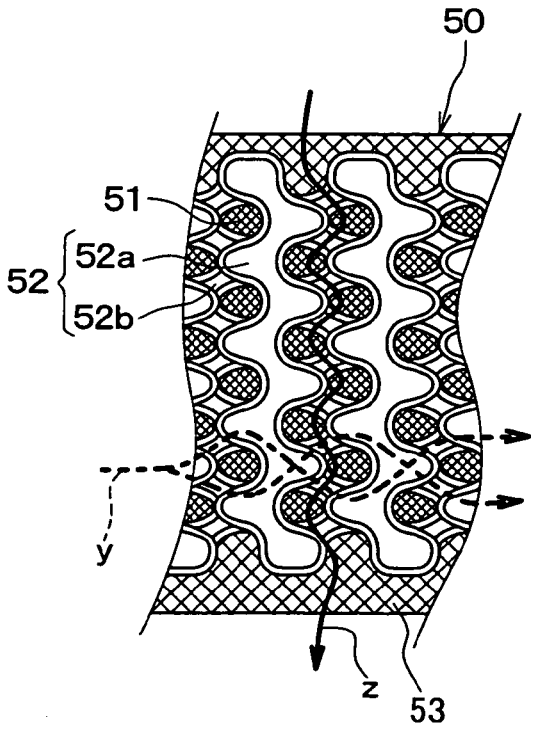
FIG. 6 PRIOR ART
FIG. 6 is a plan view showing brazing portions of a tube according to a prior art.

In contrast to the second embodiment, in the third embodiment, a planar, shape of the first protruding portions 21*a* is a substantially parallelogram as shown in FIG. 5. Each of the base plate portions 20 is configured to extend approximately straightly and continuously in the tube longitudinal direction, and the protruding portions 21 are sandwiched between the adjacent base plate portions 20 in the tube width direction.

In the third embodiment, the base plate portions 20 and the first protruding portions 21*a* are configured to define the air pressures 23 such that air flows in the air passages 23 with colliding against wall surfaces of the first protruding portions 21*a*, and thereby, thermal conductivity of the air is further increased. In the example of FIG. 5, the caulking portion 11*a* is not shown.

Other Embodiments

In the above-described embodiments, the first and second protruding portions 21*a* and 21*b* are configured by using two different plate portions. However, one of the first and second protruding portions 21*a* and 21*b* may be formed as one plate portion and the other plate portion may be formed into a flat shape.

In the above-described embodiment, the caulking portion 11*a* is formed at one end portion of the tube 11 in the tube width direction. However, the caulking portion 11*a* may not be used.

In the above-described embodiments, the tube 11 is formed by bending a single plate material. However, the tube 11 may be formed by bonding two separate plate materials. In this case, caulking portions 11*a* may be formed on both end portions of the tube 11 in the tube width direction.

In the above-described embodiment, the tube 11 is used for the heat exchanger 10 in which the fins 12 are located between stacked tubes 11. However, the tube 11 may be used for the heat exchanger 10 without a fin, in which a plurality of tubes 11 are stacked.

While the invention has been described with reference to preferred embodiments thereof, it is to be understood that the invention is not limited to the preferred embodiments and constructions. The invention is intended to cover various modification and equivalent arrangements. In addition, while the various combinations and configurations, which are preferred, other combinations and configurations, including more, less or only a single element, are also within the spirit and scope of the invention.

What is claimed is:

1. A tube for a heat exchanger, the tube extending in a longitudinal direction and having a flat shape in cross section along a width direction substantially perpendicular to the longitudinal direction, the tube comprising:

a first plate portion; and a second plate portion located opposite to the first plate portion, wherein the first plate portion and the second plate portion each include base plate portions which are bonded to each other and a plurality of protruding portions having at least a first protruding portion and a second protruding portion, the plurality of protruding portions protruding from the bonded portion of the base plate portions toward an outside of the tube, wherein a protruding dimension of the first protruding portion from the base plate portion is larger than a protruding dimension of the second protruding portion from the base plate portion, wherein the base plate portion and the plurality of protruding portions are configured to respectively extend in the longitudinal direction, wherein the second plate portion and the plurality of protruding portions of the first plate portion are configured to have a clearance therebetween defining an internal fluid passage in which an internal fluid flows in the longitudinal direction, wherein the second protruding portion and the base plate portion are configured to define an external fluid passage in which an external fluid flows in the width direction; and wherein the bonded portion of the base plate portions of the first and second plate portions extends continuously in the longitudinal direction between adjacent first protruding portions in the width direction to separate the adjacent first protruding portions from each other in the width direction.

2. The tube for the heat exchanger according to claim 1, wherein at least the first plate portion of the first and second plate portions includes a plurality of the base plate portions, wherein the base plate portions and the protruding portions are alternately arranged in the width direction, and wherein each of the base plate portions extends in the longitudinal direction.

3. The tube for the heat exchanger according to claim 1, wherein the base plate portion and the plurality of protruding portions extend in the longitudinal direction while being bent meanderingly in the width direction.

4. A heat exchanger comprising:

a plurality of the tubes according to claim 1, the tubes being stacked in a stacking direction perpendicular to the longitudinal direction and the width direction.

5. The heat exchanger according to claim 4, further comprising:

a plurality of fins each of which is located between adjacent tubes in the stacking direction.

6. The tube for the heat exchanger according to claim 1, wherein a width dimension of the first protruding portion in the width direction is equal to a width dimension of the second protruding portion in the width direction.

7. The tube for the heat exchanger according to claim 6, wherein the first protruding portion and the second protruding portion alternate continuously in the longitudinal direction between adjacent base plate portions.

8. The tube for the heat exchanger according to claim 1, wherein a plurality of rows of alternating first and second protruding portions are formed in the width direction of the tube.

* * * * *